US005742017A

United States Patent [19]

Perret

[11] Patent Number: 5,742,017

[45] Date of Patent: Apr. 21, 1998

[54] CIRCUIT-BREAKER PROVIDED WITH A CLOSURE RESISTANCE HAVING AN INSERTION ASSEMBLY

[75] Inventor: Michel Perret, Bourgoin-Jallieu, France

[73] Assignee: GEC Alsthom T & D SA, Paris, France

[21] Appl. No.: 689,914

[22] Filed: Aug. 16, 1996

[30] Foreign Application Priority Data

Aug. 18, 1995 [FR] France ..... 95 09935

[51] Int. Cl.[6] ..... H01H 33/16; H01H 33/88

[52] U.S. Cl. ..... 218/143; 218/58; 218/59; 218/63

[58] Field of Search ..... 218/43, 45, 48, 218/57–67, 143

[56] References Cited

U.S. PATENT DOCUMENTS

| | | | |
|---|---|---|---|
| 3,567,885 | 3/1971 | Boersma | 218/66 X |
| 3,745,284 | 7/1973 | Hosokawa | 218/61 |
| 4,338,500 | 7/1982 | Pham Van et al. | 218/143 |
| 4,421,962 | 12/1983 | Thuries et al. | 218/143 |
| 4,500,762 | 2/1985 | Yoshizumi | 218/143 |

FOREIGN PATENT DOCUMENTS

| | | |
|---|---|---|
| 2450501 | 9/1980 | France . |
| 7905478 | 9/1980 | France . |
| 2487560 | 1/1982 | France . |
| 2503448 | 10/1982 | France . |
| 2657459A1 | 7/1991 | France . |

*Primary Examiner*—J. R. Scott

*Attorney, Agent, or Firm*—Sughrue, Mion, Zinn, Macpeak & Seas, PLLC

[57] ABSTRACT

A circuit-breaker including a moving assembly having a moving main contact (14) electrically connected to a first terminal (2A), a fixed assembly having a fixed arcing contact electrically connected to a resistance (5) which is connected to a second terminal (3A), and a temporary insertion assembly for temporarily inserting the resistance when closing the circuit-breaker. The fixed arcing contact is an elongated metal rod (11) having a first end (11A). The temporary insertion assembly includes a ring (22) that slides along and electrically contacts the metal rod. The ring has first contacts (25) that cooperate with the moving main contact (14), and second contacts (31) that cooperate with third contacts (32) connected electrically to the second terminal (3A). A first biasing member (29) biases a cylindrical insulating pusher (28) toward the moving assembly, and a second biasing member (40) biases the insertion assembly in the same direction. The moving main contact (14), first contacts (25), second contacts (31), and third contacts (32) are arranged so that, when the circuit-breaker is in the disengaged position, a first distance (d1) between the first contacts (25) and the moving main contact (14), and a second distance (d2) between the second contacts (31) and the third contacts (32) are both equal to or greater than a corresponding isolation distance for preventing re-striking of an arc between the contacts.

5 Claims, 5 Drawing Sheets

CIRCUIT-BREAKER PROVIDED WITH A CLOSURE RESISTANCE HAVING AN INSERTION ASSEMBLY

The present invention relates to a high-voltage circuit-breaker provided with a closure resistance associated with an insertion device for inserting the resistance.

BACKGROUND OF THE INVENTION

French Patent No. 79 05478 describes a circuit-breaker including a resistance that is intended to be momentarily inserted in series in the circuit of the circuit-breaker on circuit-breaker closing. Such insertion is intended to limit voltage surges that occur in particular on closing long lines that are unloaded.

In the above-mentioned document, the resistance is disposed inside the interrupting chamber, and it is associated with an insertion mechanism which is also placed inside the interrupting chamber.

The insertion mechanism includes an insertion contact coupled to the moving equipment of the circuit-breaker, constituted by a tungsten ring, and co-operating with a contact coupled to the fixed assembly of the circuit-breaker, and also constituted by a tungsten ring. Electric contact is established end-to-end, and occurs with a relatively large impact, which explains the choice of tungsten as the material of the contacts. Such rings are costly. The ring coupled to the moving equipment is heavy, and a large amount of energy is required for getting it quickly up to speed, which energy must be taken into account when selecting the power for driving the circuit-breaker, and this makes the circuit-breaker more costly. The impact between the two rings gives rise to impact effects and risks of bouncing, so that the mechanism must also include damping elements which also increase the cost of the circuit-breaker. The overall size and in particular the diameter of the tungsten rings is large, so that the diameter of the porcelain enclosing the interrupting chamber is large.

OBJECTS AND SUMMARY OF THE INVENTION

An object of the present invention is to provide a mechanism including no heavy parts, so that the power required for driving it can be reduced and its cost can be reduced.

Another object of the present invention is to provide a mechanism that does not require a device for damping on contact being made by the insertion contacts.

Another object of the invention is to provide an insertion mechanism of small diameter, thereby making it possible to reduce the diameter of the porcelain casing, and to reduce its cost.

The invention provides a circuit-breaker including, for each phase, an interrupting chamber enclosed by a substantially cylindrical insulating casing inside which the following are disposed coaxially: a moving assembly including in particular a moving main contact, a moving arcing contact, and a blast piston co-operating with a blast cylinder terminated by a blast nozzle, the moving contacts being connected to a first terminal; and a fixed assembly including a fixed arcing contact in series and in alignment with a resistance and co-operating with a temporary insertion assembly for temporarily inserting the resistance on circuit-breaker closing, the resistance being connected to a second terminal; wherein, with the fixed arcing contact being formed by an axial metal rod, the insertion assembly includes a ring mounted to slide with electrical contact along the metal rod, and carrying first contacts on the moving assembly side of the ring, which contacts are designed to co-operate with the moving main contact, and second contacts on the other side, which contacts can co-operate with fixed third contacts connected electrically to the second terminal, the insertion assembly further including a cylindrical insulating pusher pushed by a first spring bearing against the ring, the insertion assembly being subjected to drive force from a second spring bearing against the fixed assembly and tending to displace the insertion assembly towards the moving assembly, the moving main contact, and the first contacts, the second contacts and the third contacts being organized so that, when the circuit-breaker is in the disengaged position, the distance between the first contacts and the moving main contact, and the distance between the second contacts and the third contacts are not less than the isolation distance corresponding to the voltage of the chamber.

According to another characteristic, the insertion assembly further includes a piston secured to the ring and sliding on the fixed arcing contact and inside a cylinder which is secured to the fixed assembly and which is provided with calibrated openings so as to form a suction retarder.

The insertion assembly includes a damping cylinder integral with the ring, and co-operating with an abutment secured to the fixed arcing contact.

BRIEF DESCRIPTION OF THE DRAWINGS

The invention will be well understood on reading the following description of an embodiment of the invention given with reference to the accompanying drawings, in which.

MORE DETAILED DESCRIPTION

Figure 1:
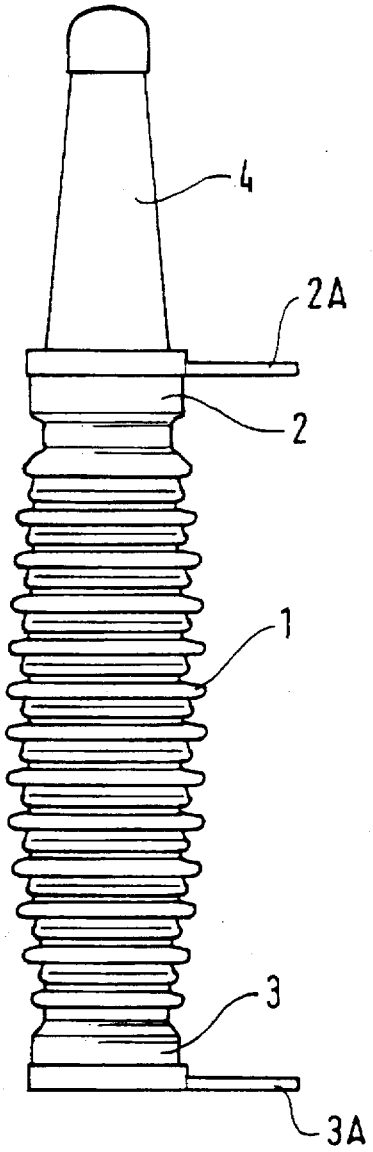
FIG. 1 is a view of an interrupting chamber of a circuit-breaker with a closure resistance.

FIG. 1 shows an interrupting chamber of a circuit-breaker with a closure resistance. The interrupting chamber includes a gastight insulating casing generally made of porcelain, and closed by two end plates 2 and 3 equipped with respective terminals, namely a first terminal 2A and a second terminal 3A. The inside of the casing is filled with an insulating gas (preferably sulfur haxafluoride (SF6) under a pressure of a few hundred hectopascals). A closure resistance is disposed in alignment with the casing 1 inside a metal cap 4 which communicates with the inside of the casing and which provides an electrical link between one end of the resistance and the terminal 2A.

It should be noted that, for each phase, the same circuit-breaker may include a plurality of interrupting chambers of the above-mentioned type connected in series.

Furthermore, the invention as described in the present patent application is also applicable to "metal-clad" installations having grounded metal casings. In this case, the porcelain casing 1 is replaced by a grounded metal casing, e.g. made of aluminum, and the terminals are insulated.

Figure 2:
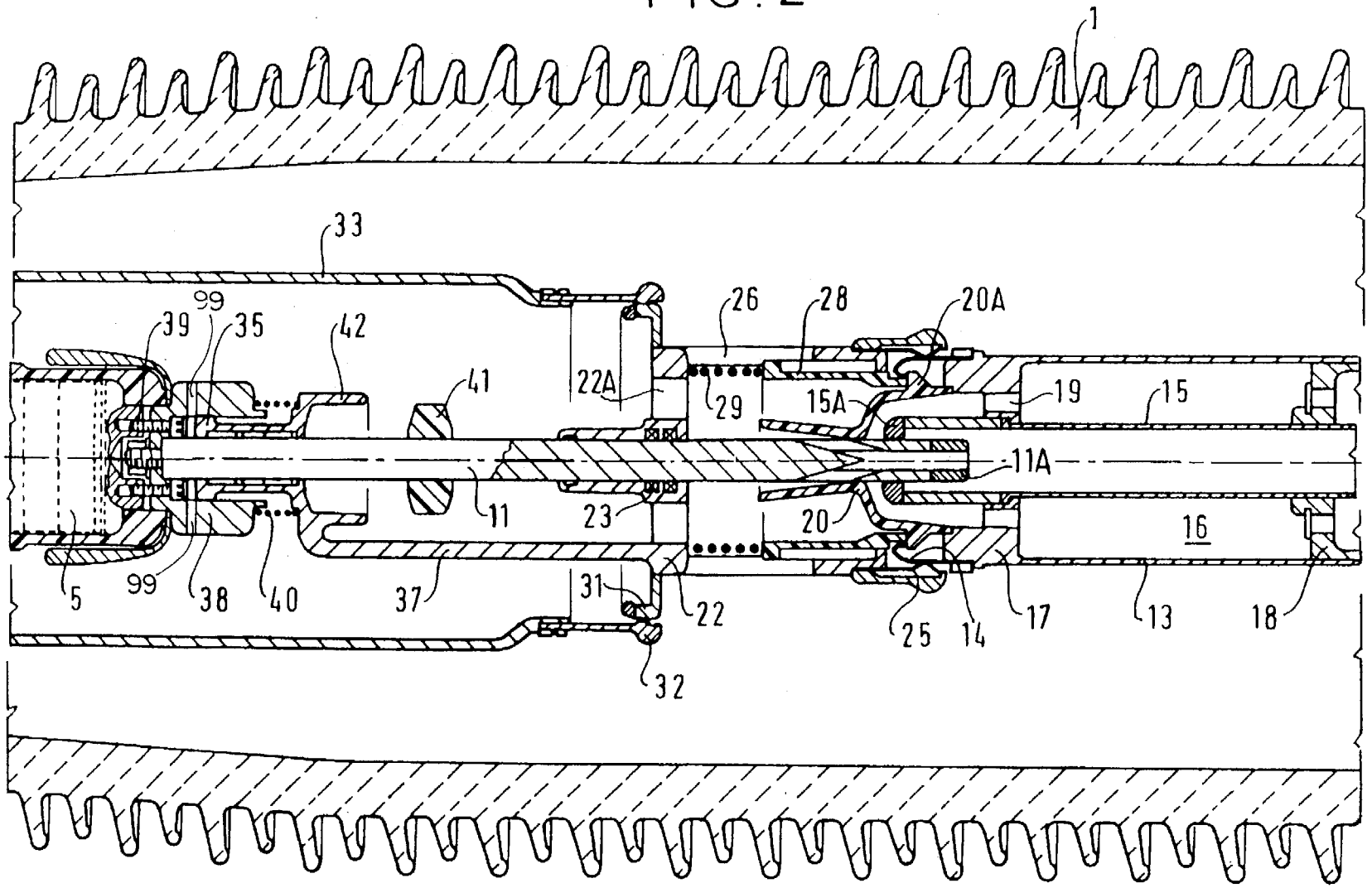
FIG. 2 is a fragmentary view in axial section through an interrupting chamber of the invention shown in the engaged position.

FIG. 2 shows a part of the interrupting chamber of the invention on a larger scale and in axial section.

The ceramic casing 1 can be seen, as can a first end of the resistance 5 comprising a stack of pellets. The second end (not shown in FIG. 2) of the resistance is electrically connected to the first terminal 2A (not shown in FIG. 2)

The fixed arcing contact of the interrupting chamber is formed by a metal rod 11, e.g. made of an alloy based on copper, provided with a first end 11A made of a material that withstands the effects of electric arcing. The material may be an alloy based on tungsten.

The moving assembly of the circuit-breaker includes a metal cylinder 13 connected mechanically to a drive rod (not shown) and electrically to the second terminal 3A (not shown in FIG. 2). A contact end-piece 14 forming the permanent contact of the moving assembly is disposed at one end of the cylinder.

A metal tube 15 is disposed coaxially inside the cylinder 13, a first end (not shown in FIG. 2) of the tube being connected electrically to the second terminal 3A, and its second end 15A being formed by contact fingers made of a material that withstands arcing effects.

The cylinder 13 and the tube 15 define an annular blast volume 16 closed at one end by a disk 17 secured to the cylinder 13 and to the tube 15, and at the other end by a fixed blast piston 18 of annular cross-section. The disk 17 is provided with through holes 19 for passing the blast gas which escapes through a blast nozzle 20.

The insertion assembly for inserting the resistance includes a metal ring 22 mounted to slide along the rod 11 and in electric contact therewith by means of sliding contacts 23. The ring is provided with through holes 22A.

The insertion assembly is therefore mounted to move relative to the fixed assembly of the interrupting chamber.

A collar of electrical contacts 25 ("first contacts") is disposed at the end of a conductive cylindrical portion 26 on one side of the ring. The contacts 25 co-operate with the end-piece 14 to pass the permanent current when the circuit-breaker is in the engaged position.

A cylindrical pusher 28 made of an insulating material is disposed on the same side as the collar 26, the pusher coming into contact with the moving assembly when the circuit-breaker is in the engaged position. The pusher is pushed by a spring 29 bearing against the ring 22. In the example shown in the figure, the pusher 28 bears against a shoulder 20A of the nozzle 20.

The ring 22 further carries a contact part 31 co-operating with a fixed cylindrical contact 32 secured to fixed metal arms 33 connected electrically to the first terminal 2A and secured mechanically to the corresponding end of the interrupting chamber. The contacts 31 ("second contacts ") and the contacts 32 ("third contacts") are in electric contact when the circuit-breaker is in the engaged position.

The insertion assembly further includes a piston 35 mounted to slide on the rod 11, and connected to the ring 22 via arms 37, e.g. three arms spaced apart angularly by 120°. The piston 35 slides in a fixed cylinder 38 secured to the metal block 39 placed at the end of the resistance 5. The cylinder 38 is provided with calibrated openings 98 opening out to the outside so as to constitute a retarder for retarding the insertion moving assembly as it moves towards the right of the figure. A spring 40 bearing at one end on the outside wall of the cylinder 38 and at its other end on angled portions of the arms 37 tends to push the insertion assembly towards the right of the figure.

The insertion assembly is supplemented by a cylindrical abutment 41 made of an insulating material, secured to the rod 11, and engaging in a cylinder 42 when the insertion assembly comes to the end of its stroke towards the right of the figure, which cylinder 42 is part of the insertion moving assembly. This disposition makes it possible to damp the end-of-stroke impact of the insertion moving assembly.

When the circuit-breaker is engaged, current flows from the first terminal to the second terminal successively via the arms 33, the contacts 32 and 31, the ring 22, the cylindrical portion 26, the contacts 25 and 14, and the cylindrical tube 13.

Figure 3:
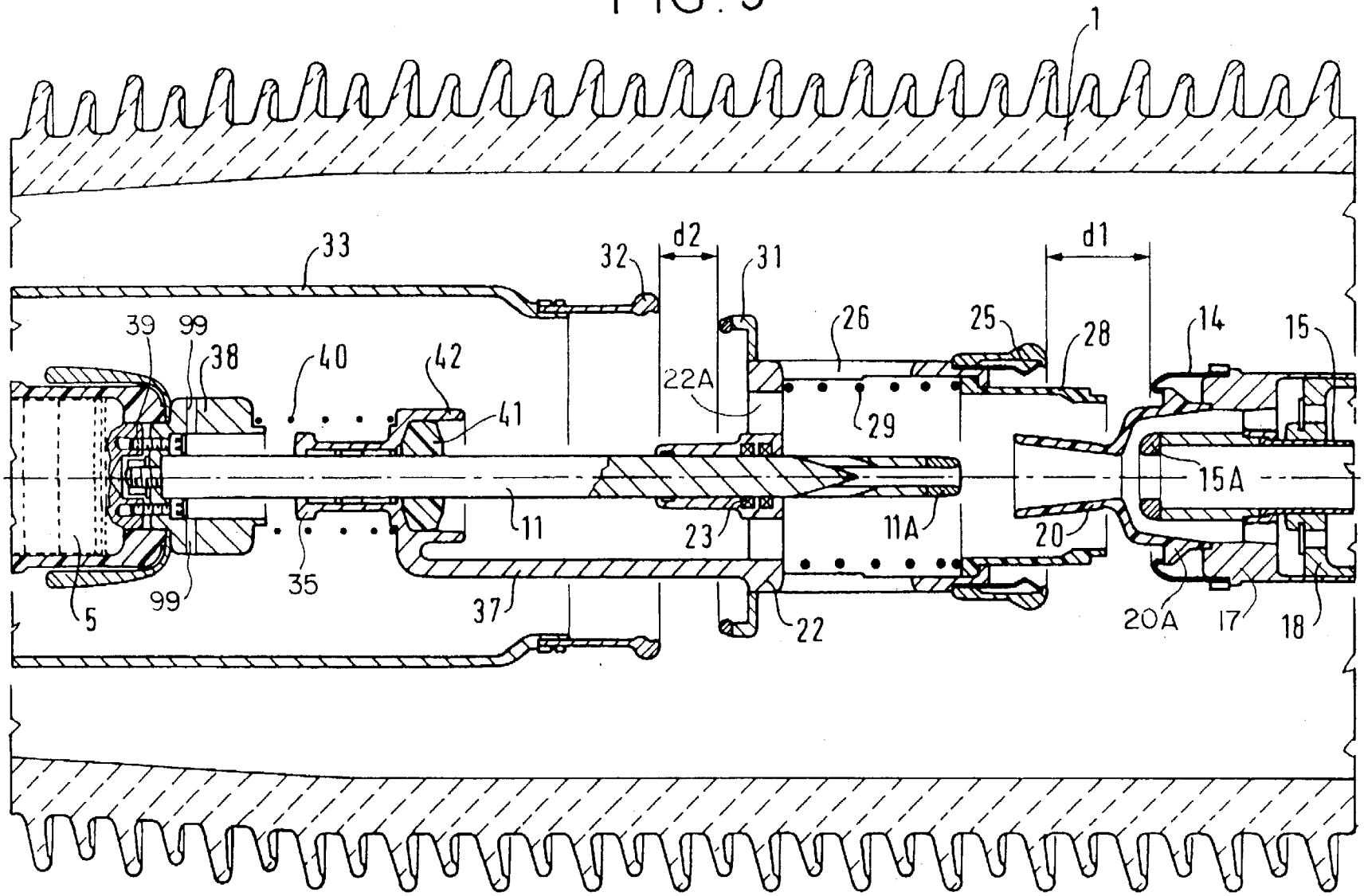
FIG. 3 is a fragmentary view in axial section through the same chamber, the circuit-breaker being in the disengaged position.

FIG. 3 shows the interrupting chamber in the disengaged position.

The insertion assembly is in its end position abutting against the abutment 41. It should be noted that the distance d1 between the contacts 25 and the moving main contact, and the distance d2 between the contacts 31 and 32 are greater than the isolation distance at the voltage of the interrupting chamber. This condition is necessary to avoid any re-striking of an arc between contacts.

A description follows of how the invention makes it possible for the resistance 5 to be inserted for a limited duration during closure (engagement) of the circuit-breaker.

On circuit-breaker closing, the moving equipment is displaced towards the left of the figures.

Figure 4:
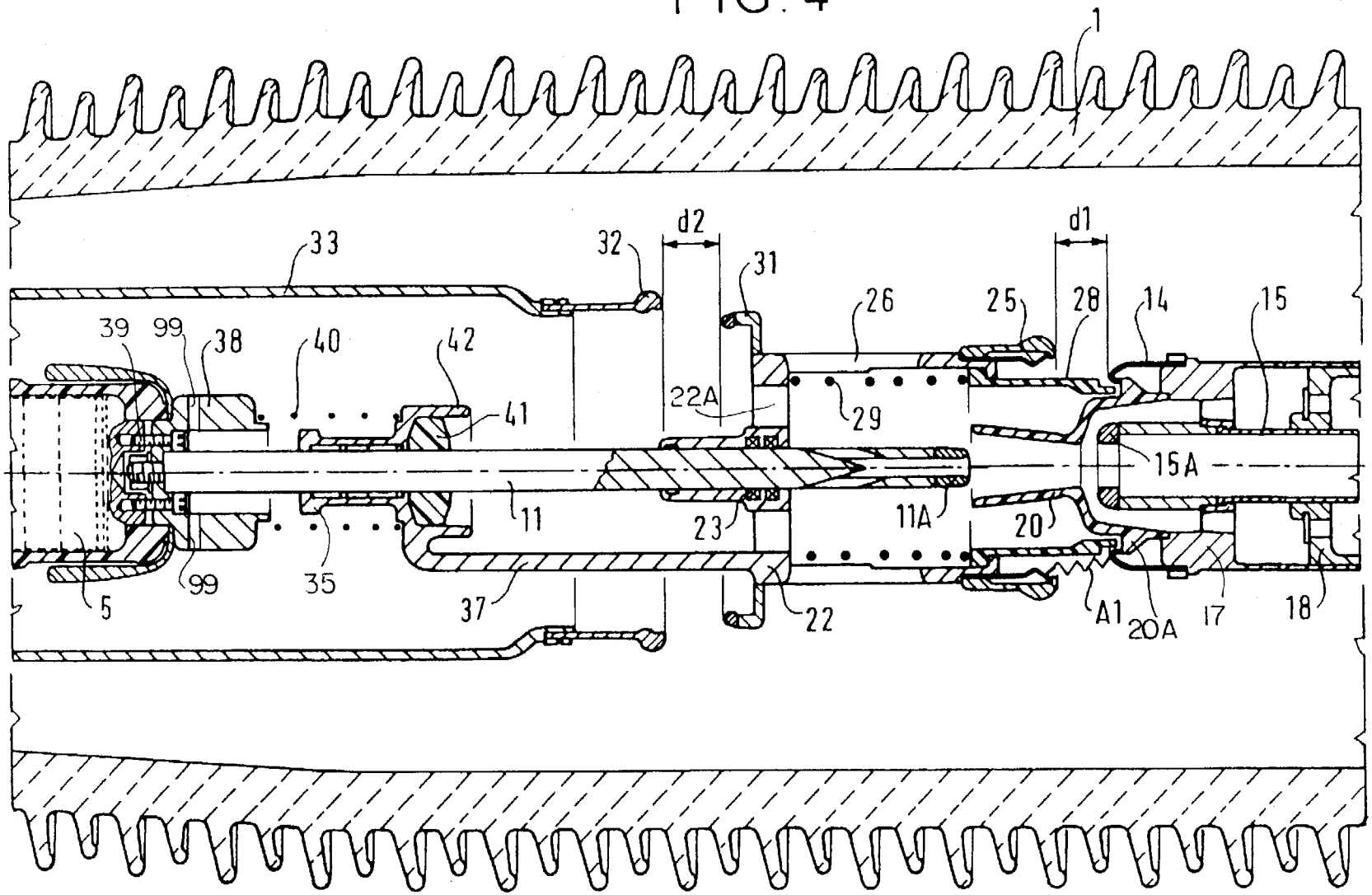
FIGS. 4 and 5 are fragmentary views in axial section through the same interrupting chamber, showing the various steps of circuit-breaker engagement.

FIG. 4 shows the configuration after the moving equipment has travelled a short distance.

The contacts 14 and 25 have been brought closer together, without the insertion assembly having moved. As soon as the distance d1 becomes less than the isolation distance, an arc A1 strikes between the contacts 14 and 25, and current passes through the cylindrical portion 26, the ring 22, the contacts 23, the rod 11, and the resistance 5. The resistance is thus inserted.

The moving equipment continues its stroke, and entrains the insertion assembly because the spring 29 of the pusher 28 has reached the end of its compression stroke.

Figure 5:
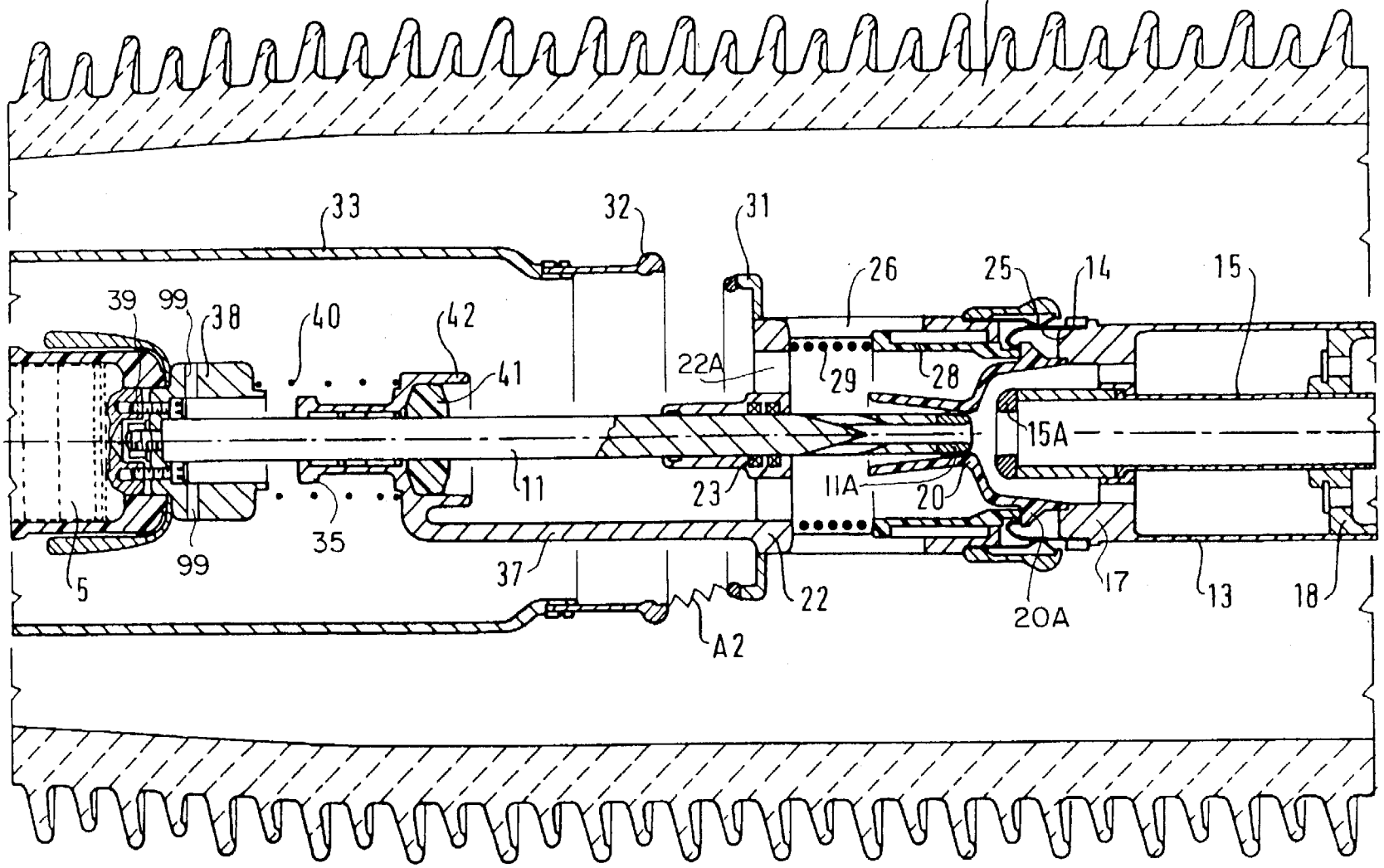

As soon as the distance d2 between the contacts 31 and 32 becomes less than the isolation distance (FIG. 5), an arc A2 strikes between said contacts, the resistance 5 is short-circuited, and current flows from the second terminal to the first terminal via the cylinder 13, the contacts 14 and 25, the cylindrical portion 26, the ring 22, the contact 31, the arc A2, the contact 32, and the arms 33.

The dimensions of the various elements of the interrupting chamber are chosen to take into account the speed of displacement of the moving assembly, so as to ensure that the resistance 5 is inserted for long enough, e.g. for in the range 8 milliseconds to 12 milliseconds.

The moving assembly continues to travel leftwards until it reaches the end of the stroke, at which time the contacts 31 and 32 are in contact and the chamber has the configuration shown in FIG. 2

On disengagement, the moving assembly is pulled rightwards by the drive rod. The permanent current contacts 14 and 25 move apart, and then the arcing contacts **15*a* and 11A** move apart.

Because of its inertia, and because of the retarder constituted by the cylinder 38, the insertion assembly remains stationary until the current is interrupted. In this way, the resistance 5 remains short-circuited during the entire current-interrupting stage, and it is therefore not inserted on opening.

Since the moving assembly continues along its stroke, the contact between the pusher 28 and the moving assembly ceases when the spring 29 arrives at the end of its stroke. Under the action of the spring 40, the insertion assembly is displaced along the rod 11 until it comes into abutment against the abutment 41, at which time the contacts 31 and 32 are spaced apart by a distance d2 that is greater than the isolation distance (configuration shown in FIG. 3). The cylinder 42 and the abutment 41 constitute a very simple damping device.

The insertion assembly of the invention is light in weight, so that the energy required for driving the circuit-breaker is not increased by the insertion assembly.

The maximum diameter of the insertion assembly, i.e. the diameter of the arms 33 and of the contact 32 is small, so that the diameter of the porcelain is not increased by the presence of the insertion assembly.

The insertion assembly needs no device for damping on insertion, which constitutes a saving.

The invention applies to "open" or "metal-clad" high-voltage circuit-breakers.

I claim:

1. A circuit-breaker having one or more phases, each phase comprising an interrupting chamber enclosed by an insulating casing (1), said circuit-breaker comprising the following components arranged coaxially inside said insulating casing:

a moving assembly comprising a moving main contact (14), a moving arcing contact (15A), and a blast piston (18) co-operating with a blast cylinder (13) terminated by a blast nozzle (20), said moving contacts being electrically connected to a first terminal (2A); and a fixed assembly including a fixed arcing contact in series and in alignment with a resistance (5) and co-operating with a temporary insertion assembly for temporarily inserting the resistance on circuit-breaker closing, said resistance being connected to a second terminal (3A), wherein said fixed arcing contact comprises an elongated metal rod (11) having a first end (11A), the insertion assembly comprises a ring (22) mounted to slide along said metal rod and in electrical contact with said metal rod, said ring carrying first contacts (25) on a moving assembly side of said ring, said first contacts cooperating with said moving main contact (14), and said ring carrying second contacts (31) on a side of said ring opposite said moving assembly side, said second contacts cooperating with fixed third contacts (32) connected electrically to the second terminal (3A), the insertion assembly further comprising a cylindrical insulating pusher (28) pushed by a first spring (29) bearing against said ring, the insertion assembly being subjected to a drive force from a second (40) bearing against said fixed assembly and tending to displace the insertion assembly towards the moving assembly, wherein the moving main contact (14), the first contacts (25), the second contacts (31), and the third contacts (32) are disposed so that, when the circuit-breaker is in the disengaged position, a first distance (d1) between the first contacts (25) and the moving main contact (14), and a second distance (d2) between the second contacts (31) and the third contacts (32) are both equal to or greater than a corresponding isolation distance for preventing re-striking of an arc between the contacts.

2. A circuit-breaker according to claim 1, wherein the insertion assembly comprises a piston (35) secured to said ring (22) and sliding on said metal rod (11) and inside a cylinder (38) which is secured to said fixed assembly.

3. A circuit-breaker according to claim 1, wherein the insertion assembly comprises a damping cylinder (42) integral with said ring (22), and co-operating with an abutment (41) secured to said metal rod (11).

4. A circuit-breaker comprising:

a moving assembly comprising a moving main contact (14) electrically connected to a first terminal (2A);

a fixed assembly including a fixed arcing contact electrically connected to a resistance (5), said resistance being connected to a second terminal (3A); and a temporary insertion assembly for temporarily inserting the resistance when closing the circuit-breaker, wherein said fixed arcing contact comprises an elongated metal rod (11) having a first end (11A), said temporary insertion assembly comprises a ring (22) mounted to slide along said metal rod and in electrical contact with said metal rod, said ring carrying first contacts (25) on a moving assembly side of said ring, said first contacts cooperating with said moving main contact (14), and said ring carrying second contacts (31) on a side of said ring opposite said moving assembly side, said second contacts cooperating with third contacts (32) connected electrically to the second terminal (3A), wherein said temporary insertion assembly further comprises a cylindrical insulating pusher (28) biased by a first biasing member (29) in a direction toward said moving assembly, said temporary insertion assembly being biased by a second biasing member (40) in the same direction as said cylindrical insulating pusher, and wherein said moving main contact (14), said first contacts (25), said second contacts (31), and said third contacts (32) are disposed so that, when the circuit-breaker is in the disengaged position, a first distance (d1) between said first contacts (25) and said moving main contact (14), and a second distance (d2) between said second contacts (31) and said third contacts (32) are both equal to or greater than a corresponding isolation distance for preventing re-striking of an arc between the contacts.

5. A circuit-breaker according to claim 2, wherein said cylinder (38) comprises calibrated openings to retard suction of said piston (35) in said cylinder (38).

* * * * *